US006196591B1

(12) United States Patent
Lieth

(10) Patent No.: US 6,196,591 B1
(45) Date of Patent: Mar. 6, 2001

(54) OBJECT IN PARTICULAR OFFICE BINDER AND METHOD FOR THE MANUFACTURE THEREOF

(76) Inventor: Wolfgang H. Lieth, Konstantinstr. 283-285, Moncheng D-41238 (DE)

( * ) Notice: Subject to any disclaimer, the term of this patent is extended or adjusted under 35 U.S.C. 154(b) by 0 days.

(21) Appl. No.: 09/201,859

(22) Filed: Dec. 1, 1998

(51) Int. Cl.[7] ..... B42D 3/00

(52) U.S. Cl. ..... 281/37; 281/29; 281/36; 281/37; 402/70; 402/73; 412/900; 412/902

(58) Field of Search ..... 281/29, 36, 37; 402/70, 73; 412/902, 900; 283/36

(56) References Cited

U.S. PATENT DOCUMENTS

| | | | | |
|---|---|---|---|---|
| 3,174,773 | * | 3/1965 | True et al. | 281/29 |
| 5,368,333 | * | 11/1994 | Arroyo | 281/29 |
| 5,575,504 | * | 11/1996 | Wagner | 281/29 |
| 5,720,564 | * | 2/1998 | Winzen | 281/29 |

FOREIGN PATENT DOCUMENTS

| | | |
|---|---|---|
| 000831 | 6/1996 | (AU) . |
| 33 13 879 | 10/1984 | (DE) . |
| 901 542 62 | 2/1991 | (DE) . |
| 423 919 42 | 5/1993 | (DE) . |
| 197 053 93 | 4/1998 | (DE) . |

OTHER PUBLICATIONS

"Erdol und Erdgas bis Formazanfarbstoffe", Ullmans Encyklopadie der technischen Chemie.

"Keramische Farben bis Kork", Ullmans Encyklopadie der technischen Chemie.

Verkaufs–Preisliste Informationen Daten–Preise—GM-P–Laminiersysteme.

* cited by examiner

*Primary Examiner*—Stephen F. Gerrity
*Assistant Examiner*—Daniel Phan
(74) *Attorney, Agent, or Firm*—Liniak, Berenato, Longacre & White, LLC

(57) ABSTRACT

An office binder, having a surface made of board, paper, coated paper, paperboard, or plastic film, on which a transparent film is attached over part of it surface via attachment surfaces in order to form a film pocket. A method for equipping the office binder, having a surface made of board, paper, coated paper, or plastic film, with a film pocket, in which a film having an adhesive side is laid onto the surface and is attached over part of the surface via adhesive attachment surfaces.

10 Claims, 2 Drawing Sheets

5
6

8b
8a
2
9
10
8
20

OBJECT IN PARTICULAR OFFICE BINDER AND METHOD FOR THE MANUFACTURE THEREOF

BACKGROUND OF THE INVENTION

1. Field of the Invention

The invention concerns an object, in particular an office binder, having a surface made of board, paper, coated paper, paperboard, or plastic film, on which a transparent film is attached over part of its surface via attachment surfaces in order to form a film pocket. The invention further concerns a method for equipping an object, in particular an office binder, having a surface, made of board, paper, coated paper, paperboard, or plastic film, with a film pocket, in which a film having an adhesive side is laid onto the surface and is attached over part of the surface via adhesive attachment surfaces.

2. Description of Related Art

It is known in the existing art to arrange on office binders—for example on the exterior of the spine of the binder or on the exterior or interior of a binder cover—a film pocket into which correspondingly shaped board elements for application of an inscription or prefabricated information media can be inserted via an opening. The two walls of the film pocket comprise on the one hand the surface of the office binder itself and on the other hand a film applied onto said surface. Examples thereof are evident from DE 90 15 426 U1, DE 42 39 194 A1, DE 33 13 879 A1, and AT 000 831 U1.

In the binder disclosed in DE 90 15 426 U1, the surface can consist of paperboard, paper, or plastic. Depending on the material, provision is made for correspondingly adapted attachment of the film to form the film pocket, an adhesive or heat-sealed join being proposed therefor. DE 42 39 194 A1 describes an office binder in which the spine region is laminated with a paper. In order to allow the film forming the film pocket to be applied onto the spine region, a strip of plastic film material is first applied in planar fashion onto the spine in the region of the film pocket, specifically using an adhesive. Then a second film is laid on, and heat-sealed at the lateral edges and the lower edge of the film that was first applied.

The office binder as defined in DE 33 13 879 A1 has a plastic surface. A transparent film made of PVC, which is heat-sealed at the edges to the plastic surface of the binder as is usual with plastic binders, is used for the film pocket. Lastly, AT 000 831 U1 discloses a binder about whose surface condition nothing other is said. A transparent plastic film attached with an adhesive seam is used to form the film pocket. The adhesive seam indicated is any type of join, using adhesive, heat-sealing, or stamping, that is known in the art.

The methods known so far for attaching films in order to form a film pocket are relatively complex and expensive, since the films—insofar as the surface is made of paper or a material similar to paper—must be additionally equipped with a layer of adhesive, although this does not result in satisfactory adhesion. DE 42 39 194 A1 therefore proposes an even more complex manner of attachment. Attachment with the aid of heat-sealed seams is suitable only for applying a film to plastic surfaces.

SUMMARY OF THE INVENTION

It is the object of the invention to configure an office binder with a film pocket in such a way that the film pocket can be manufactured economically, and durable attachment can be attained.

A further object is that of making available a method suitable therefor.

The first part of the object is achieved, according to the present invention, in that the film is configured as a composite film which has a support layer and, on the side facing the surface of the object, a heat-activatable adhesive layer, and the adhesive join is produced by heat activation without additional adhesive. In this context, "heat activation" is understood to mean a heat treatment in which the plastic becomes tacky, which is usually associated with plasticization.

Composite films have already been known for some time in the existing art (Ullmanns Enzyklopädie der technischen Chemie [Ullmann's encyclopedia of chemical engineering], 4th edition, vol. 11, 1976, pages 680 and 684; and vol. 14, 1977, page 249). They generally comprise a support layer and a heat-activatable adhesive layer; additional materials, for example copolymer material, can also be arranged between the support layer and adhesive layer. A polyester material is advantageously used for the support layer, and a polyethylene material for the adhesive layer.

The invention has the advantage that additional actions, such as application of an adhesive, use of adhesive paper, or treatment of the board, paper, or paperboard surface, are not necessary. In addition, outstanding adhesion between the two materials is achieved. The composite film is suitable not only for the manufacture of film pockets on office binders, but also for all other objects which have a surface made of board, paper, or paperboard and which are to be fitted with a film pocket, for example packaging cartons, book and booklet bindings, periodicals (for example in order to attach data media), etc. The attachment surfaces can be provided in accordance with the respective purpose. As a rule, they extend in strip form on or near the edge. The film pocket can also be configured in closed fashion if a prefabricated information medium or data medium is to be enclosed in lossproof fashion.

In the existing art, composite films are often used as so-called laminating films, in order to heat-seal information media and data media, for example badges, cards, documents, operating instructions, etc., between two composite films. This is done in laminating devices which subject the composite films to the action of heat and pressure over the entire surface, so that the respective adhesive layers located on the inside are also activated over the entire surface. To ensure that the externally located support layer is not impaired in this context, i.e. so that transparency, gloss, and brilliancy are retained, the material is selected in such a way that the adhesive layer is already activatable at a temperature at which the support layer does not yet suffer any impairment. This is not absolutely necessary for the present method, since the heat activation is confirmed to the attachment surfaces and transparency there is not required. Appearance is improved, however, if impairment of the support layer is avoided in this region as well.

The thickness of the support layer should be at least 40%, or better at least 55% of the total thickness of the composite film, since this has proven to be an advantageous distribution of the layers. The thickness of the film can lie between 20 and 1000 um, preferably between 60 and 400 um.

There of course exists the possibility of applying externally onto the film a further film—called the outer film—in order to form between these two films a film pocket, if such is desired. Application of the outer film can be accomplished in the same manner as application of the inner film onto the surface of the object; the film pocket can also be prefabricated, and can then be applied to the surface as a unit. The same film can be used for the inner film as for the outer film, and can be applied in the same arrangement.

As regards the method for equipping the object with a film pocket, the object is achieved according to the present invention in that a composite film is used which has a support layer and, on the side facing the surface of the object, a heat-activatable adhesive layer; and that the composite film is exposed only on the attachment surfaces, during or after placement onto the surface, to a heat treatment such that it is heat-activated at least on the adhesive side; and that it additionally receives an application of pressure at least on the attachment surfaces.

According to the present invention, the film is secured to the surface of the object by way of a combined pressure and heat treatment, at least the heat treatment being confined to the attachment surfaces. Heat activation and thus an adhesive effect correspondingly also occur only there. The size and configuration of the attachment surfaces can be selected without restriction. The pressure necessary for carrying out the method, and the temperature required, will be selected by the person skilled in the art as a function of the thermoplastic material of the film that is used, and as a function of its thickness. As a rule, even a slight contact pressure will suffice, while the heat treatment is limited at the lower end by the temperature at which no heat activation of the adhesive side has yet occurred. The upper limit is defined by the thermal stability of the plastic material used, and of the surface of the object. The optimum temperature region is to be determined in each individual case, taking in account heating and cooling time as well as cost-effectiveness.

The contact pressure and the heat treatment can be applied using a correspondingly shaped and heated stamping tool. In order to prevent adhesion of the film to said tool, the tool should be coated with PTFE at least the pressing surfaces.

BRIEF DESCRIPTION OF THE DRAWINGS

FIG. 1 illustrates the invention in more detail with reference to a schematically depicted exemplary embodiment. It shows an office binder 1 of ordinary configuration. It has a spine 2 and binder covers 5, 6 articulated on both vertical sides via folds 3, 4. Spine 2 and binder covers 5, 6 are made of board or paperboard, and are laminated on the exterior and interior with paper.

Figure 1:
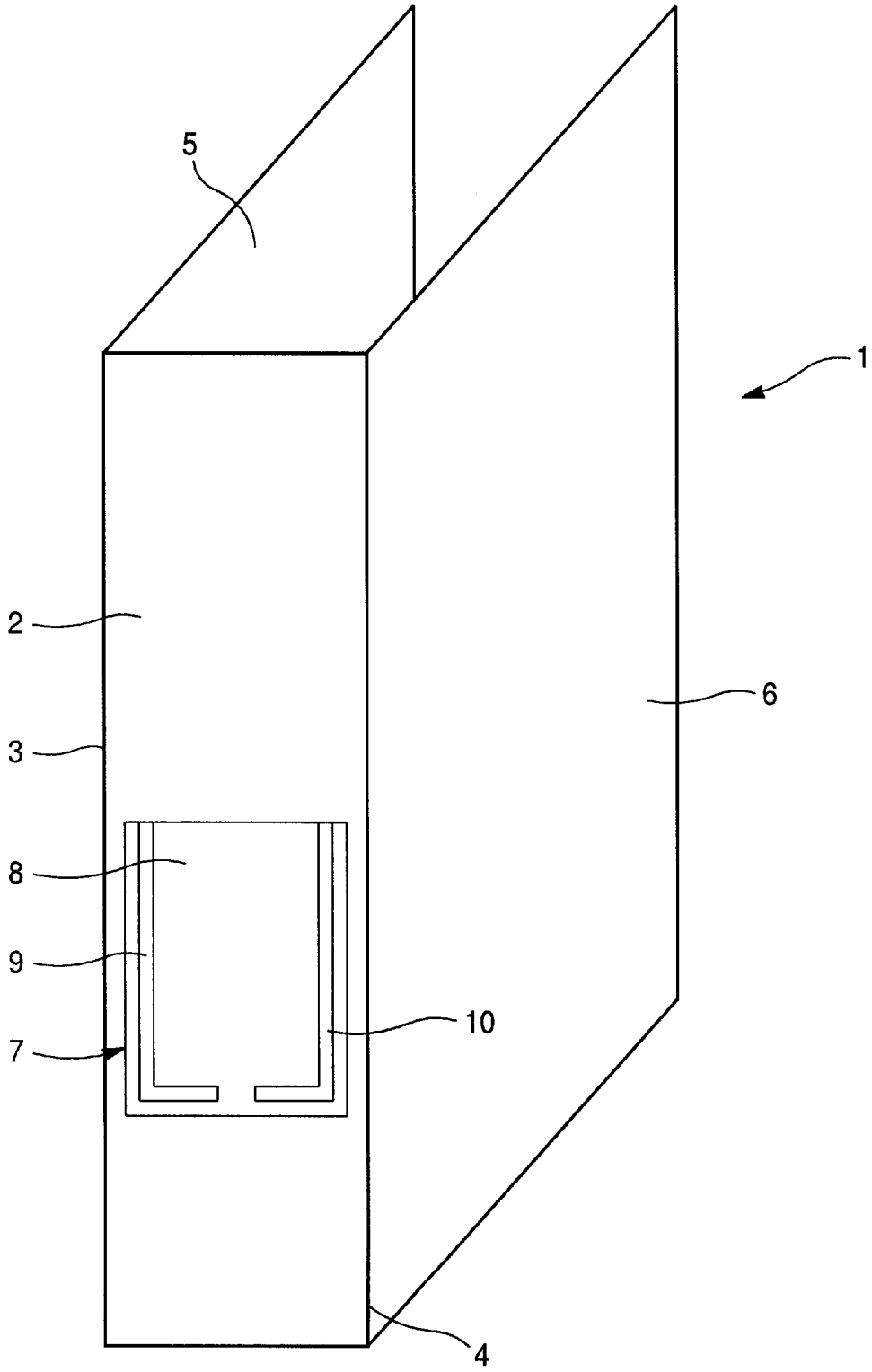
FIG. 1 is a schematic perspective view of the binder having a film pocket formed along its spine.
Figures 2A, 2B:
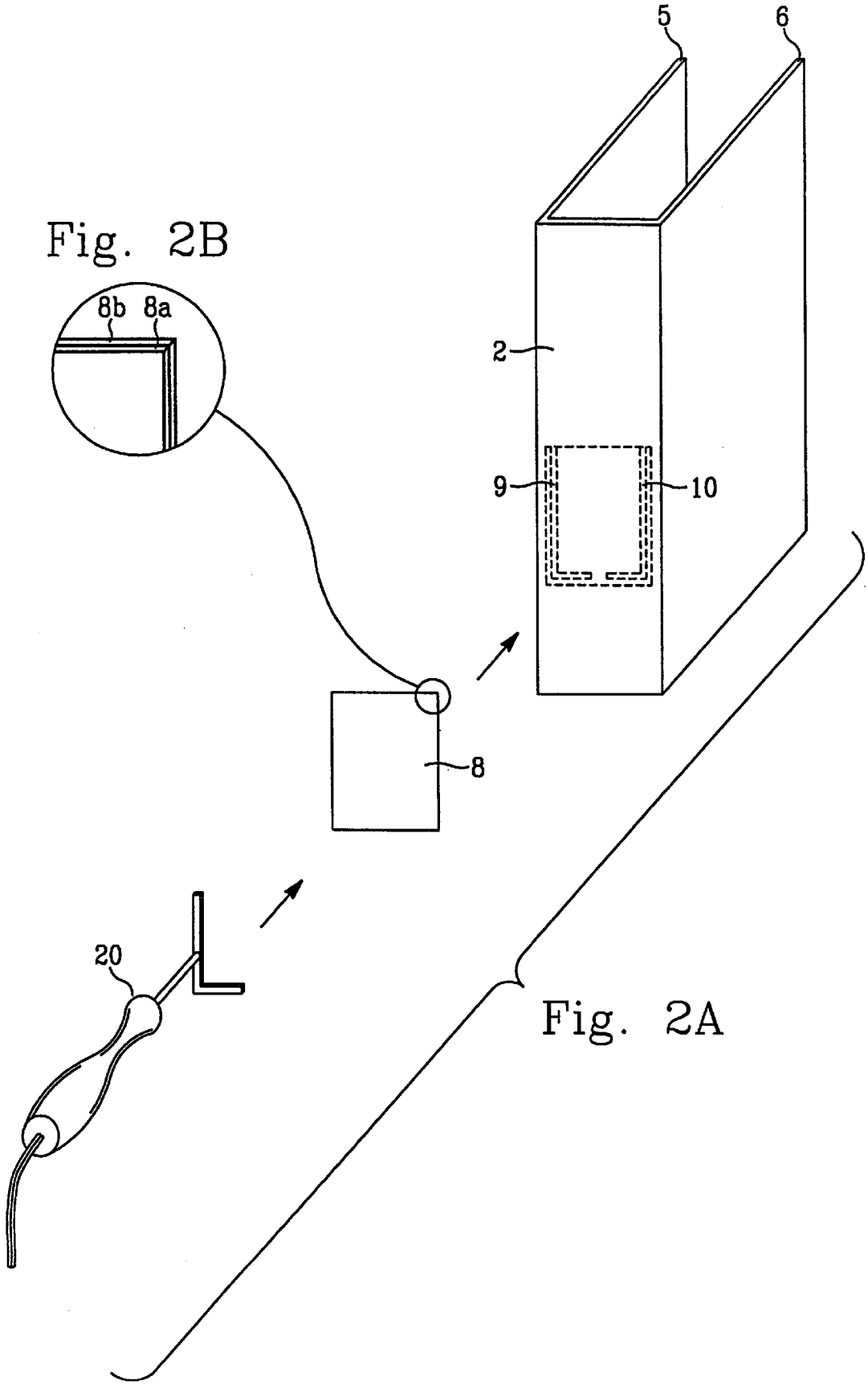
FIGS. 2A and 2B are exploded views of the binder arrangement of FIG. 1.

Spine 2 has a film pocket 7. It is formed by the fact that a single rectangular composite film 8 is secured to spine 2 with its support layer 8*a* on the outside and its adhesive layer 8*b* facing spine 2 (see FIG. 2B). Securing is accomplished at two attachment surfaces 9, 10 which are each of L-shaped configuration and arranged in mirror-image fashion. They extend in the form of strips, close to the vertical side edges and the lower edge of composite film 8.

Attachment of composite film 8 to spine 2 was accomplished by laying composite film 8 onto spine 2 and then pressing onto composite film 8, from the outside, a heated stamping tool 20 corresponding to the profile of attachment surfaces 9, 10. By the action of pressure and heat, the side of composite film 8 facing spine 2 was heat-activated, i.e. plasticized to such an extend that it became adhesive on attachment surfaces 9, 10. Since the externally located support layer of composite film 8 is more temperature-resistant than the internally located adhesive layer, the support layer was not impaired, i.e. it suffered no structural modification except for the impressions due to the applied pressure.

The following composite films are suitable, for example, for office binder 1, the support layer being formed in each case by the polyester layer and the adhesive layer by the polyethylene layer:

| Film | Total thickness* of film | Thickness* of polyester layer | Thickness* of polyethylene layer | Thickness of copolymer layer |
|---|---|---|---|---|
| 1 | 80 | 50 | 30 | — |
| 2 | 125 | 75 | 25 | 25 |
| 3 | 175 | 125 | 25 | 25 |
| 4 | 250 | 175 | 40 | 35 |

*All thicknesses in um

Temperatures on the order of 160 to 250 degrees C. proved suitable, utilizing exposure times of 1 to 5 seconds. A very good result, in the form of a permanently secured and sufficiently stable film pocket, was obtained with film 3 at a temperature of 225 degrees C. and a pressing time of 2 seconds.

What is claimed is:

1. An object having a surface (2) made of board, paper, coated paper, paperboard, or plastic film, on which a transparent film (8) is attached over part of said surface via attachment surfaces (9, 10) in order to form a film pocket (7), wherein the film is configured as a composite film (8) which has a support layer and a heat-activatable adhesive layer overlying substantially an entire side of said support layer facing the surface (2); and an adhesive joint is produced between said support layer and said surface by beat activation of selected portions of said adhesive layer without additional adhesive.

2. The object as defined in claim 1, wherein the support layer is made of a polyester material, and the adhesive layer of a polyethylene material.

3. The object as defined in claim 1, wherein the adhesive layer is already activatable at a temperature at which the support layer does not yet suffer any impairment.

4. The object as defined in claim 1, wherein a copolymer material is arranged between the support layer and adhesive layer.

5. The object as defined in claim 1, wherein the thickness of the support layer is at least 40%, preferably at least 55% of the total thickness of the composite film.

6. The object as defined in claim 1, wherein the composite film (8) has a thickness of 20 to 1000 um.

7. The object as defined in claim 6, wherein the composite film (8) has a thickness of from 60 to 400 um.

8. The object as defined in one of claim 1, wherein an outer film is adhesively bonded onto the composite film (8), forming a film pocket between the two films.

9. A display pocket for a binder, said display pocket comprising:

a substrate having a surface made of one of board, paper, coated paper, paperboard, and a plastic film, a transparent film adapted to be attached over part of said surface in order to form a film pocket, wherein the film is a composite film having a support layer and a heat-activatable adhesive layer covering substantially the support layer, said heat-activatable adhesive layer being substantially coextensive with said support layer, and wherein an adhesive joint is produced between said film and said surface when pressure and heat are applied to said adhesive layer.

10. A combination plastic film and binder, said combination comprising:

a binder having a surface made of one of board, paper, coated paper, paperboard, and a plastic film, a transparent film adapted to be attached over part of said surface in order to form a film pocket, wherein the film is a composite film having a support layer and a heat-activatable adhesive layer covering substantially the support layer, said heat-activatable adhesive layer being substantially coextensive with said support layer, and wherein an adhesive joint is produced between said film and said surface when pressure and heat are applied to said adhesive layer.

* * * * *